United States Patent [19]

Chujo et al.

[11] Patent Number: 4,459,669

[45] Date of Patent: Jul. 10, 1984

[54] METHOD AND APPARATUS FOR CONTROLLING THE AIR-FUEL RATIO IN AN INTERNAL COMBUSTION ENGINE

[75] Inventors: Yoshiki Chujo, Susono; Takehisa Yaegashi, Mishima; Shinichi Sugiyama, Susono, all of Japan

[73] Assignee: Toyota Jidosha Kogyo Kabushiki Kaisha, Toyota, Japan

[21] Appl. No.: 276,996

[22] Filed: Jun. 24, 1981

[30] Foreign Application Priority Data

Jun. 30, 1980 [JP] Japan ..... 55-87917

[51] Int. Cl.[3] ..... F02B 3/04; F02M 51/00; F02D 35/00

[52] U.S. Cl. ..... 364/431.06; 123/440; 123/480; 364/431.05

[58] Field of Search ..... 364/431.05, 431.06; 123/437, 440, 480, 486, 489; 60/276, 285

[56] References Cited

U.S. PATENT DOCUMENTS 4,263,652 4/1981 Henrich ..... 123/440 X 4,290,107 9/1981 Suda et al. ..... 123/440 X 4,314,537 2/1982 Asano et al. ..... 123/440

4,324,218 4/1982 Hattori et al. ..... 123/440

4,345,562 8/1982 Drews et al. ..... 123/440

4,355,615 10/1982 Asano et al. ..... 123/440 X 4,359,029 11/1982 Furuhashi et al. ..... 123/440

*Primary Examiner*—Felix D. Gruber

*Attorney, Agent, or Firm*—Cushman, Darby & Cushman

[57] ABSTRACT

An output voltage from an $O_2$ sensor is intermittently sampled and the sampled voltage is converted into a binary signal. The binary signal is applied to an electrical digital computer, and therein the following operations are carried out. First, the maximum value or the maximum and minimum values of the applied binary signal are detected, then a reference value is calculated using the maximum value or the maximum and minimum values from a predetermined algebraic function. Thereafter, the applied binary signal is compared with the calculated reference value to generate a binary signal indicative of the comparison result. Then, the air-fuel ratio of the engine is adjusted in response to this binary signal calculated by the digital computer.

16 Claims, 11 Drawing Figures

| |
|---|
| Fig. 3A |
| Fig. 3B |

METHOD AND APPARATUS FOR CONTROLLING THE AIR-FUEL RATIO IN AN INTERNAL COMBUSTION ENGINE

BACKGROUND OF THE INVENTION

The present invention relates to an air-fuel ratio feedback control method of an internal combustion engine, and more specifically to an air-fuel ratio feedback control method using an electrical digital computer.

An internal combustion engine, in general, emits gases containing pollutants such as carbon monoxide (CO), nitrogen oxides (NOx), unburned or partly burned hydrocarbons (HC). When these pollutants are to be cleaned using a three-way catalytic converter, it is required to very precisely control the air-fuel ratio within a range around the stoichiometric air-fuel ratio such that all of the three components, i.e., CO, NOx and HC can be removed effectively.

Therefore, the internal combustion engine employing the above-mentioned three-way catalytic converter usually adopts a method of controlling the feedback of air-fuel ratio responsive to signals from a concentration sensor (exhaust gas sensor) which detects the concentrations of particulr components in the exhaust gas. Among many concentration sensors, an oxygen concentration sensor (Hereinafter referred to as $O_2$ sensor) for detecting the oxygen concentration has been extensively used for automobiles, such as a stabilized zirconia element or a titania element. When the air-fuel ratio in the atmosphere hovers around 14.5 (stoichiometric air-fuel ratio), the $O_2$ sensor of this type exhibits suddenly changed electric properties. In other words, the $O_2$ sensor detects the changes in the air-fuel ratio causing the electric signals thereof to change.

The $O_2$ sensors, however, have different characteristics depending upon the individual units, and they also exhibit a great variation in temperature characteristics. Therefore, in order to control the air-fuel ratio over a wide range of temperatures of the engine, while suppressing control errors that may stem from individual characteristics, a particular contrivance must be provided to treat the output voltage of the $O_2$ sensor. One method may be to vary or control a reference voltage for comparison. Namely, the output voltage of the $O_2$ sensor is compared with the reference voltage by a comparator, to discriminate whether the air-fuel ratio at the present moment is rich or lean. In this case, the reference voltage for comparison can have variable values responsive to a maximum value in the output voltage of the $O_2$ sensor.

The conventional air-fuel ratio control systems of this type, which rely upon variable values for comparison, employ an analog control circuit. Accordingly, only very simple control functions could be obtained from the complicated circuitry, and it was very difficult to accomplish optimum control of the air-fuel ratio maintaining a high precision. As mentioned earlier, in order to effectively clean the exhaust gas by using a three-way catalytic converter, it is necessary that the air-fuel ratio is precisely controlled to an optimum value responsive to the operation condition. With conventional analog control systems, it is almost impossible to attain an optimum air-fuel ratio control without using complex circuitry, which causes the costs to be increased.

SUMMARY OF THE INVENTION

It is, therefore, an object of the present invention to provide an air-fuel ratio control method and apparatus which is capable of realizing precise and optimum air-fuel ratios under various operating conditions, and which can be realized using a cheaply constructed device.

According to the present invention, an air-fuel ratio control method comprises the steps of: intermittently sampling a voltage signal from an exhaust gas sensor which detects the concentration of a predetermined component in the exhaust gas and converting the sampled voltage signal into an electrical signal in the form of a binary number; applying the converted binary signal to an electrical digital computer; detecting the maximum value or the maximum and minimum values of the applied binary signal to generate a maximum value signal or maximum and minimum signals, by means of said digital computer the generation of the signals occuring only when the electrical signal resulting in the maximum signal is greater than a first setpoint and the electrical signal resulting in the minimum signal, if any, is less than a second setpoint; calculating, by means of said digital computer, a reference value in accordance with said maximum value signal or with said maximum value and minimum value signals by using a predetermined algebraic function; changing a reference signal from the previous value to said calculated reference value; comparing, by means of said digital computer, the magnitude of the reference signal with the magnitude of said applied binary signal to obtain a binary signal which indicates the comparison result; and adjusting the air-fuel ratio of the engine in response to said binary signal indicating the result of the comparison.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
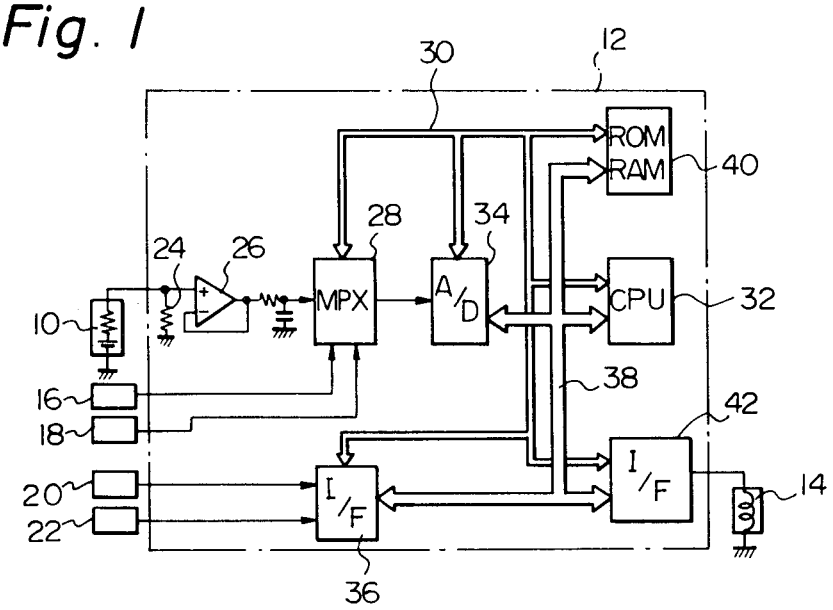
FIG. 1 is a block diagram schematically illustrating an embodiment of the present invention.

FIG. 1 is a block diagram illustrating an embodiment according to the present invention, which employs a stabilized zirconia element as an $O_2$ sensor. Namely, the device of this embodiment controls the air-fuel ratio by adjusting the amount of fuel supplied from a fuel injection valve responsive to the output voltage of the $O_2$ sensor. In FIG. 1, reference numeral 10 denotes the above-mentioned $O_2$ sensor, 12 denotes a control circuit including an electrical digital computer, and 14 denotes a fuel injection valve. In addition to signals from the $O_2$ sensor, the control circuit 12 is served with signals from an air-flow sensor 16, a coolant-temperature sensor 18, a running-speed sensor 20 and a throttle position switch 22.

The output voltage of the $O_2$ sensor is applied to an analog multiplexer 28 via a parallel resistor 24 having a resistance of several megohms and a buffer amplifier 26. The analog multiplexer 28 further receives voltage signals representing the amount of air introduced into the engine from the air-flow sensor 16, voltage signals representing the temperature of the coolant from the coolant-temperature sensor 18, and various other analog signals that represent operation conditions of the engine. These analog voltage signals are fed in a time divisional manner to an analog-to-digital converter (A/D converter) 34 owing to control signals that are fed from a central processing unit (CPU) 32 through a control bus 30, and are successively converted into electrical signals in the form of a binary number.

An input interface 36 is served with binary signals that represent the running speed of the engine produced by the running-speed sensor 20, and with signals that represent the opening state of a throttle valve (not shown) produced by the throttle position switch 22.

The A/D converter 34 and the input interface 36 are connected, via a data bus 38, to the CPU 32, to a memory 40 consisting of a read-only memory (ROM) and a random access memory (RAM), and to an output interface 42. The ROM in the memory 40 preliminarily stores a control program of the digital computer, a variety of operation constants which have been determined beforehand by experiments, and initial values. The output interface 42 receives a value related to the fuel injection time that is calculated by the CPU 32, converts the value into a binary (pluse) having a variable pulse signal width and sends it to a fuel injection valve (or valves) 14. Therefore, the opening time of the injection valve 14 is controlled, the amount of fuel injection is controlled, and the feedback of the air-fuel ratio is controlled.

Figure 2:
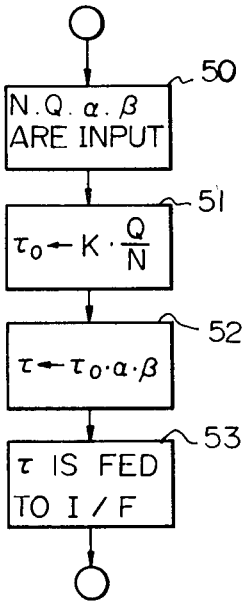
FIGS. 2, 3A and 3B are flow charts of parts of control programs in the embodiment of FIG. 1.

It is widely known to arithmetically determine the fuel injection time with a digital computer in accordance with engine operating conditions. For example, the arithmetic operation is carried out according to a flow chart as schematically illustrated in FIG. 2, although its details are not mentioned here. The CPU 32 executes the arithmetic operation as shown in FIG. 2 responsive to every predetermined crank angle or request of interrupt at every predetermined period of time. At a point 50, first, the CPU 32 takes out, from the RAM, the data N related to the running speed, the data Q related to the amount of air taken in, the correction factor $\alpha$ of the water temperature, and the correction factor $\beta$ related to the feedback of the air-fuel ratio. These data N and Q have already been obtained from the sensors 16 and 20, and are temporarily stored in the RAM. Further, the correction factor $\alpha$ is calculated beforehand responsive to water-temperature signals from the sensors 18, and is temporarily stored in the RAM. The correction factor $\beta$ is calculated by the method of the present invention, as will be mentioned below, and is temporarily stored in the RAM.

Then, an arithmetic calculation of $\tau_0 = K \cdot Q/N$ is carried out at a point 51, and an operation for correction $\tau = \tau_0 \cdot \alpha \cdot \beta$ is carried out at a point 52. Here, K represents a constant. The thus calculated value $\tau$ is then fed to the output interface 42, as a fuel injection time.

Figures 3, 3A:
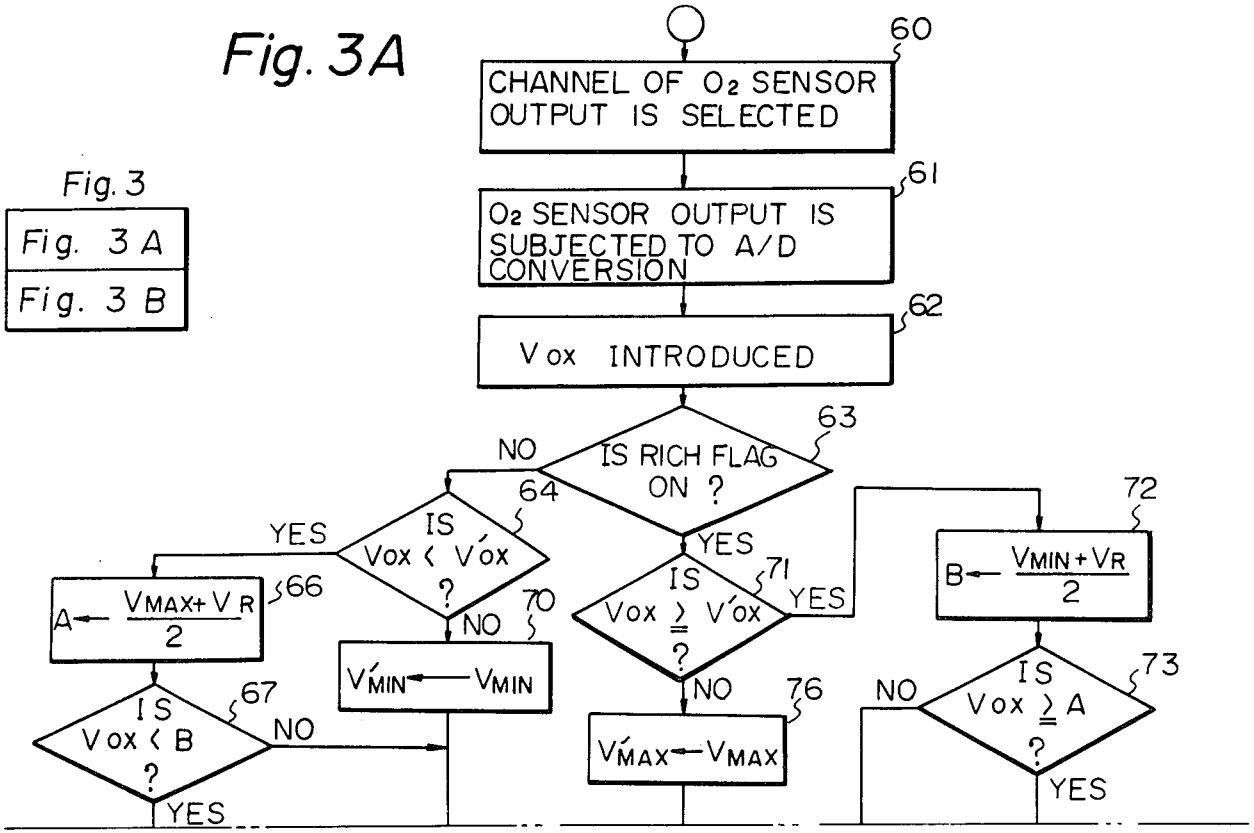
Figure 3B:
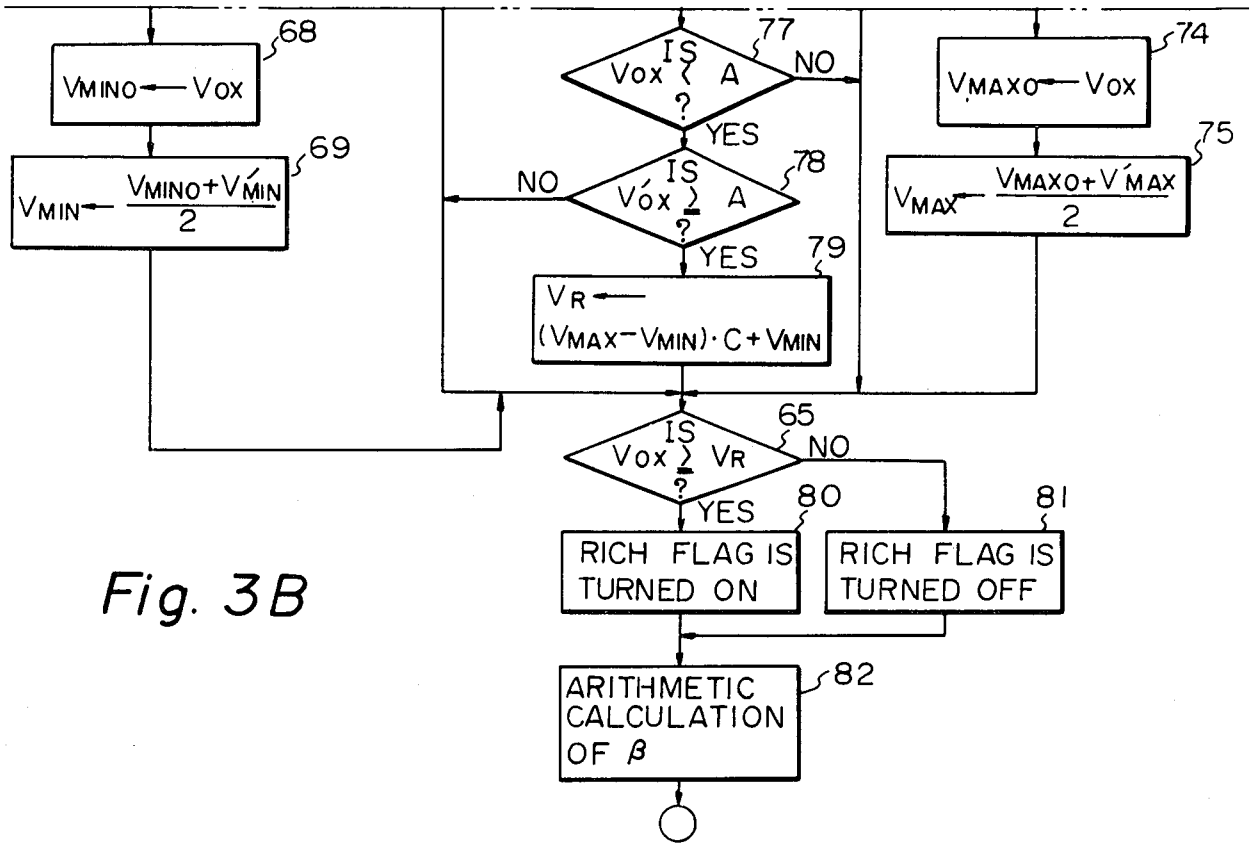

FIG. 3A and 3B illustrate a routine for calculating the above-mentioned correction factor $\beta$. The operation of the embodiment will be mentioned below in detail with reference to FIG. 3A and 3B.

The CPU 32 executes the routine shown in FIG. 3 at every predetermined period of time, for example, at every 4 to 8 msec. At a point 60, first, the CPU 32 instructs the multiplexer 28 to select the channel of the $O_2$ sensor 10, and at a point 61, the CPU 32 instructs the A/D converter 34 to subject the output voltage of the $O_2$ sensor 10 to the A/D conversion. At a point 62, thereafter, an output voltage data Vox of the $O_2$ sensor which is converted into a binary signal is introduced, and a step 63 discriminates whether the rich flag is on or off. The rich flag will have been set to on or off in the previous cycle of arithmetic operation. When the rich flag is off, i.e., when the input data Vox is smaller than a reference value in the previous cycle of arithmetic operation, and the engine is in the lean condition, the program proceeds to a point 64 where the input data V'ox in the previous cycle is compared with the input data Vox of this time with regard to their magnitude. The comparison at the point 64 is to discriminate whether the output voltage of the $O_2$ sensor 10 is increasing or decreasing. When Vox $\geqq$ V'ox, the program proceeds, via a point 70, to a point 65 where the input data Vox is compared with a reference value $V_R$. When Vox $<$ V'ox i.e., when the engine is in the lean condition and when the output voltage of the $O_2$ sensor 10 is decreasing, the program proceeds to a point 66 where a setpoint value A, which is used for calculating a maximum value of the input data Vox, is found from a relation $$A = \frac{V_{MAX} + V_R}{2}.$$

Here, $V_{MAX}$ and $V_R$ represent a maximum value in the input data Vox determined in the previous or earlier cycle of arithmetic operation, and a reference value, respectively. Then, at a point 67, the CPU 32 discriminates whether the input data Vox is greater than a setpoint value B or not. When Vox $\geqq$ B, the program proceeds to the above-mentioned point 65. Only when Vox $<$ B, the program proceeds to routines of points 68 and 69 where a minimum value $V_{MIN}$ is renewed. Namely, $V_{MINO}$ is set equal to Vox at the point 68, and calculation of $$V_{MIN} = \frac{V_{MINO} + V'_{MIN}}{2}$$

is performed at the point 69. Here, $V'_{MIN}$ represents a minimum value $V_{MIN}$ calculated in the previous time. When Vox $\geqq$ V'ox at the point 64, i.e., when the engine is in the lean condition and when the output voltage is increased, the minimum value $V_{MIN}$ this time is stored as $V'_{MIN}$ in the RAM of the memory 40 at the point 70. Then, the program proceeds to the point 65.

If at the point 63, the CPU 32 so discriminates that the rich flag is on, the program proceeds to a point 71 where the previous input data V'ox is compared with the input data Vox of this time with regard to their magnitude. When Vox $\geqq$ V'ox, the program proceeds to a point 72. Namely, when it is so discriminated that the engine is in the rich condition while the output voltage of the $O_2$ sensor 10 is rising or remains fixed, the program proceeds to a point 72 where a setpoint value B used in the abovementioned point 67 is calculated from $$B = \frac{V_{MIN} + V_R}{2}.$$

At a point 73, the CPU 32 discriminates whether the input data Vox is greater than, or equal to, the setpoint value A that is found in the point 66. When Vox $<$A, the program proceeds to the point 65. Only when Vox $\geqq$A, the program proceeds to the routines of points 74, 75 to renew the maximum value $V_{MAX}$. Namely, $V_{MAXO}$ is equalized to Vox at the point 74, and calcuation of $$V_{MAX} = \frac{V_{MAXO} + V'_{MAX}}{2}$$

is performed at the point 75 to find the maximum value $V_{MAX}$. The program then proceeds to the point 65. Here, $V'_{MAX}$ is equal to the maximum value $V_{MAX}$ which was calculated in the previous cycle, and the maximum value $V_{MAX}$ calculated this time is stored as $V'_{MAX}$ in the RAM of the memory 40 at the next point 76.

20 When it is so discriminated that Vox $<$V'ox at the point 71, i.e., when it is discriminated that the engine is in the rich condition and the output voltage of the $O_2$ sensor 10 is decreasing, the program proceeds to a point 77 via the above-mentioned point 76. At points 77 and 78, the input data Vox of this time and the input data V'ox of the previous operation cycle are compared with the setpoint value A. The program proceeds to the point 79 only when V'ox $\leqq$A and Vox $<$A. The program proceeds to the point 65 in other cases. At the point 79, the reference value $V_R$ for comparison is renewed according to $V_R = (V_{MAX} - V_{MIN}) \cdot C + V_{MIN}$, where C is a predetermined operation constant.

At the point 65, the input data Vox is compared with the reference value $V_R$ with regard to their magnitude. When Vox $\geqq V_R$, the program proceeds to a point 80 where the rich flag is turned on. When Vox $< V_R$, the program proceeds to a point 81 where the rich flag is turned off. The program then proceeds to a point 82.

At the point 82, the correction factor $\beta$ related to the feedback of the air-fuel ratio is calculated depending upon the on or off of the rich flag. When the rich flag is on, the correction factor $\beta$ is reduced by a predetermined value for each operation cycle. When the rich flag is off, the correction factor $\beta$ is increased by a predetermined value for each operation cycle. Further, when the rich flag is on in the previous operation cycle, but is off in the operation cycle of this time, or when the rich flag is off in the operation cycle of the previous time, but is on in the operation cycle of this time, the processing (skip processing) may be so effected that the correction factor $\beta$ is greatly increased or decreased in the operation cycle of this time. The thus prepared correction factor $\beta$ is stored in the RAM of the memory 40.

Figure 4:
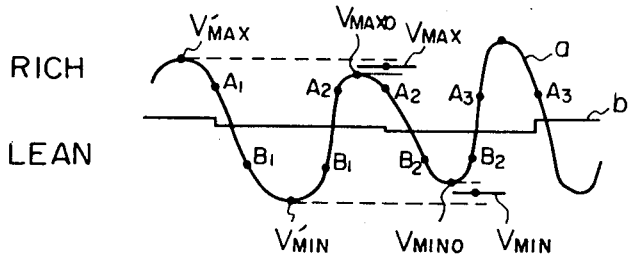
FIGS. 4 and 5 are diagrams illustrating the functions according to the embodiment of FIG. 1.
Figure 5:
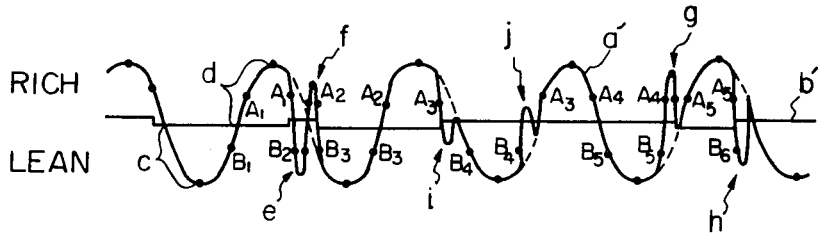

FIGS. 4 and 5 are diagrams for illustrating the function of the routine of FIG. 3, in which a represents the output voltage of the sensor 10, and b represents a reference value $V_R$ which is controlled by the arithmetic calculation.

When the distribution of air-fuel ratio is normal in the exhaust gas, the output voltage of the $O_2$ sensor 10 assumes a waveform as indicated by a in FIG. 4. When the air-fuel ratio is properly controlled, as will be obvious from FIG. 4, the output voltage a of the $O_2$ sensor 10 exceeds the setpoint value A and the setpoint value B. The program therefore passes through the points 75 and 69 of FIG. 3 to renew the maximum value $V_{MAX}$ and the minimum value $V_{MIN}$. In the routine of FIG. 3, however, the maximum value $V_{MAX}$ is found as an average value of the previous maximum value $V'_{MAX}$ and the maximum value $V_{MAXO}$ of this time, and the minimum value $V_{MIN}$ is also found as an average value of the previous minimum value $V'_{MIN}$ and the minimum value $V_{MINO}$ of this time. This is to reduce the degree of change in the maximum value and in the minimum value. According to the present invention, however, it is also allowable to utilize the maximum value $V_{MAXO}$ and the minimum value $V_{MINO}$ of this time as the maximum value $V_{MAX}$ and the minimum value $V_{MIN}$, respectively, or to utilize an average value of maximum values in the past two or more times as the maximum value and an average value of minimum values in the past two or more times as the minimum value.

The reference value $V_R$ for comparison is set to a value that is obtained by dividing the thus found maximum value $V_{MAX}$ and minimum value $V_{MIN}$ by a predetermined constant (point 79), and is renewed while the output voltage a of the $O_2$ sensor 10 decreases from the maximum value to the previous reference value. In effect, the latest maximum value is reflected by the reference value since the $O_2$ sensor 10, particularly the $O_2$ sensor 10 employing a stabilized zirconia element, exhibits the maximum value $V_{MAX}$ which is very dependent upon the temperature. Even when the reference value $V_R$ is regarded to be a function of the maximum value $V_{MAX}$ only, the temperature characteristics of the $O_2$ sensor 10 can be effectively corrected because of the reasons mentioned above. In this case, the point 79 performs the routine $V_R \leftarrow V_{MAX} \cdot C'$, and the points 72, and 67 to 70 of FIG. 3 can be eliminated.

In the processing routine of FIG. 3, whether the maximum value $V_{MAX}$, minimum value $V_{MIN}$ and reference value $V_R$ should be renewed or not, is determined by utilizing the setpoint values A and B as threshold values. This is effected for the purpose that when the air-fuel ratio in the exahust gas is non-uniformly distributed, the control point for the air-fuel ratio is corrected to a proper position without deviation, and so that excess of correction is prevented. The function will be illustrated below with reference to FIG. 5.

In FIG. 5, a' represents the output voltage of the $O_2$ sensor 10 when the air-fuel ratio is non-uniformly distributed due to the characteristics of the individual fuel injection valves and when noise has developed in the waves, and b' represents the reference value $V_R$ which is controlled by the arithmetic calculation.

As mentioned earlier, the setpoint value A is calculated at the point 66. Namely, the setpoint value A is calculated when the air-fuel ratio is in the lean condition and also the output voltage of the $O_2$ sensor 10 is decreased. This, in other words, means that the setpoint value A is calculated while the output voltage of the $O_2$ sensor 10 lies within a range indicated by c in FIG. 5. In this embodiment, the setpoint value A is selected to be a mean value of the maximum value $V_{MAX}$ which took place just before and the reference value $V_R$. The setpoint value B is calculated at the point 72 when the air-fuel ratio is in the rich state and also the output voltage of the $O_2$ sensor 10 is rising. This means that the setpoint value B is calculated while the output voltage of the $O_2$ sensor 10 lies within a range indicated by d in FIG. 5. In this embodiment, the setpoint value B is selected to be a mean value of the minimum value $V_{MIN}$ which took place just before and the reference value $V_R$. The maximum value $V_{MAX}$ is renewed only when the output voltage of the $O_2$ sensor 10 has exceeded the setpoint value A that is determined as mentioned above, and the minimum value $V_{MIN}$ is renewed only when the output voltage of the $O_2$ sensor 10 has decreased below the setpoint value B, and the reference value $V_R$ is changed by the renewal of these values. Therefore, when the air-fuel ratio has greatly changed due to the noise as indicated by e, f, g and h in FIG. 5, the reference value $V_R$ undergoes the change to correct the deviation from the proper air-fuel control point. When the air-fuel ratio has slightly changed as indicated by i and j, the reference value $V_R$ does not change, to prevent the excess of correction.

In the processing routine of FIG. 3, the setpoint value A is determined to be a mean value of the maximum value $V_{MAX}$, which took place just before, and the reference value $V_R$, and the setpoint value B is determined to be a mean value of the minimum value $V_{MIN}$, which took place just before, and the reference value $V_R$. These values, however, need not necessarily be at such a mean value or at the vicinities of maximum or minimum values, but may assume various other values depending upon the operation conditions.

Figure 6:
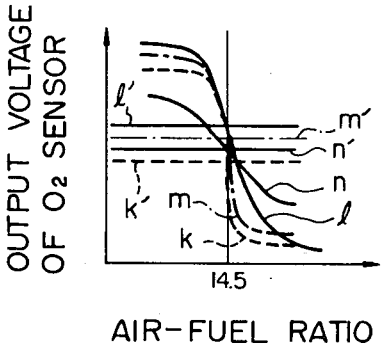
FIG. 6 illustrates a characteristic of the output voltage from the $O_2$ sensor with respect to the surrounding air-fuel ratio.
Figure 7:
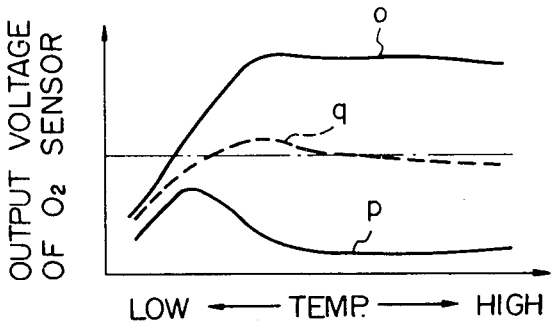
FIGS. 7 and 8 illustrate characteristics of the output voltages from the $O_2$ sensors with respect to the surrounding temperature.

According to the above-mentioned processing routine, the reference value is calculated from the maximum value or from the maximum and minimum values produced by the $O_2$ sensor in accordance with a predetermined algebraic function, and feedback of the air-fuel ratio of the engine is controlled depending upon the compared result of the thus calculated comparative value with the output of the $O_2$ sensor. Accordingly, adverse effects by the change in characteristics of the $O_2$ sensor can be prevented. The $O_2$ sensors, in general, have differences depending upon the individuals as shown in FIG. 6, and exhibit greatly varying output characteristic depending upon the temperature. Namely, in FIG. 6, the symbol k represents air-fuel ratio versus output voltage characteristics when the temperature is high, 1 represents air-fuel ratio versus output voltage characteristics when the temperature is low, m represents the difference in characteristics specific to a given $O_2$ sensor, and n represents the characteristics of an aged $O_2$ sensor. Since the reference value is changed as denoted by k', 1', m' and n' depending upon the change in characteristics, the comparison and discrimination of the $O_2$ sensor's output according to the present invention are always performed in the vicinity of the stoichiometric air-fuel ratio (about 14.5), and thus the air-fuel ratio can be controlled with high precision. Solid lines o and p of FIG. 7 represent maximum output voltage characteristics and minimum output voltage characteristics with respect to the temperature of the $O_2$ sensor employing a stabilized zirconia element, respectively. If the control in accordance with the processing routine of FIG. 3 is carried out, the reference value assumes the level as indicated by a broken line q in FIG. 7. Accordingly, the temperature range in which the air-fuel ratio feedback control can be performed is widened. In particular, it is very desirable from the standpoint of a future tendency toward lowering the exhaust gas temperature of the internal combustion engines to heighten the energy efficiency that the air-fuel ratio feedback control can be performed at temperatures lower than 400° C.

Figure 8:
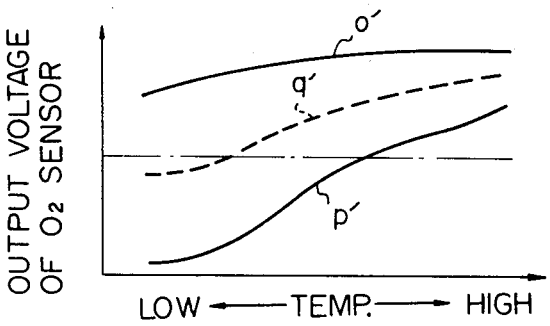

FIG. 8 illustrates maximum output voltage characteristics o' and minimum output voltage characteristics p' of a semiconductor-type $O_2$ sensor such as titania $O_2$ sensor, with respect to the temperature. The semiconductor-type $O_2$ sensor varies its resistance depending upon the oxygen concentration. When a constant voltage is applied, the output voltage varies depending upon the temperature especially in the high-temperature regions. Therefore, the air-fuel ratio control is deviated with the rise in the exhaust gas temperature, and it becomes difficult to control the feedback. If controlled according to the processing routine of FIG. 3, however, the reference value acquires the level as indicated by a broken line q' in FIG. 8; the control does not deviate even in high-temperature regions, and the temperature range for control is widened.

Figure 9:
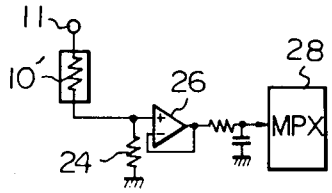
FIG. 9 is a circuit diagram illustrating a concentration detecting circuit wherein an $O_2$ sensor having the characteristic of FIG. 8 is used.

When the above-mentioned semiconductor-type $O_2$ sensor is to be used, the concentration detecting circuit including the $O_2$ sensor 10 of FIG. 1 will be constructed as illustrated in FIG. 9. Namely, a constant voltage is applied to the semiconductor-type $O_2$ sensor 10' via a terminal 11.

Figure 10:
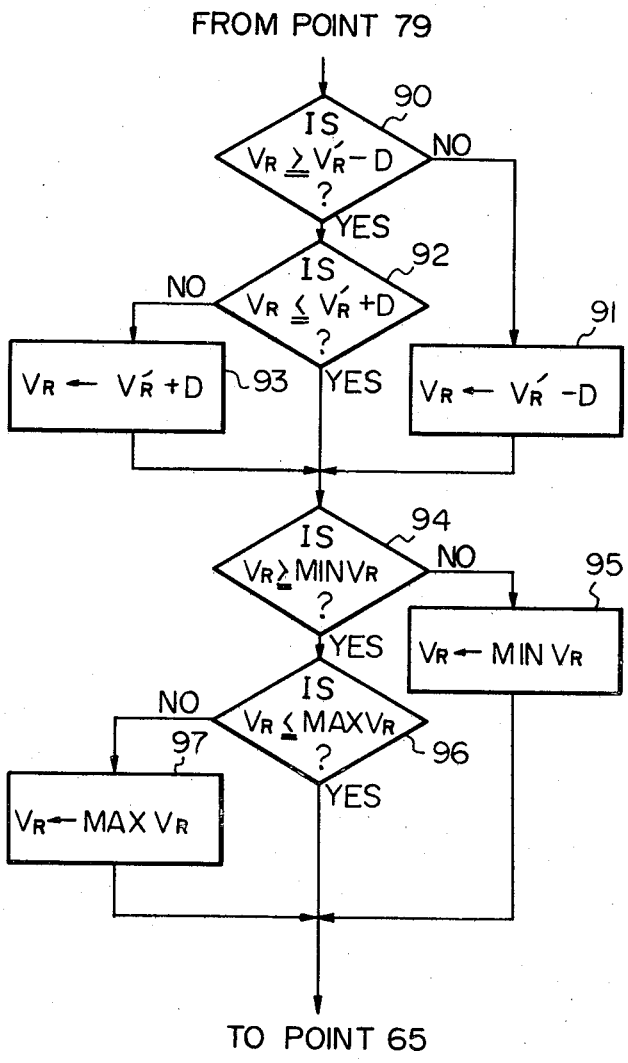
FIG. 10 is a flow chart of a part of a control program in another embodiment of the present invention.

FIG. 10 illustrates a portion of the processing routine according to another embodiment of the present invention. The processing routine of FIG. 10 comes after the point 79 of FIG. 3. Therefore, other processings of this embodiment are quite the same as those of FIG. 3.

As the reference value $V_R$ is calculated in the point 79, the program proceeds to the routines of points 90 to 93 of FIG. 10 where the reference value $V_R$ calculated this time is discriminated as to whether it lies within a range $V'_R - D \leqq V_R \leqq V'_R + D$ with respect to the reference value $V'_R$ in the previous operation cycle. When the reference value $V_R$ does not lie within the above-mentioned range, it is forcibly adjusted to become equal to $V'_R \pm D$, where D denotes a predetermined constant. The program then proceeds to the routines of points 94 to 97, where it is discriminated whether the reference value $V_R$ calculated at the point 79 and specified by the routines of the points 90 to 93 lies within a range defined between a predetermined upper-limit value $MAXV_R$ and a predetermined lower-limit value $MINV_R$. When the reference value $V_R$ does not lie within the above range, it is forcibly adjusted to become equal to either the upper-limit value $MAXV_R$ or the lower-limit value $MINV_R$. Then, the program proceeds to the point 65 to repeat the same processing that was mentioned earlier.

By effecting the processing as illustrated in FIG. 10, the degree of change in the reference value $V_R$ can be restricted lower than a predetermined value, and hence the value $V_R$ can also be confined within a predetermined range. Consequently, the reference value $V_R$ is stabilized.

According to the method of the present invention as illustrated in detail in the foregoing, it is possible to properly correct the control deviation in the air-fuel ratio caused by the characteristics of the individual $O_2$ sensors, to correct the control deviation in the air-fuel ratio caused by the change in the characteristics under various operation conditions, as well as to prevent the excess of correction. Therefore, it is allowed to reduce the temperature of the exhaust gases, to reduce the variance in the characteristics of the concentration sensors and to compensate the diminished characteristics. Furthermore, the air-fuel ratio can be controlled maintaining increased precision without requiring any additional manufacturing cost.

As many widely different embodiments of the present invention may be constructed without departing from the spirit and scope of the present invention, it should be understood that the present invention is not limited to the specific embodiments described in this specification, except as defined in the appended claims.

We claim:

1. An air-fuel ratio control method of an interal combustion engine having at least one fuel injection valve, an exhaust gas sensor for detecting the concentration of a predetermined component in the exhaust gas and for generating a voltage signal which represents the detected concentration, and an electrical digital computer, said method comprising the steps of:

intermittently sampling the voltage signal from said exhaust gas sensor to produce a first electrical signal indicative of the sampled voltage;

detecting the operating condition of the engine to produce a second electrical signal indicative of the : detected operating condition;

finding the maximum value and the minimum value of said first electrical signal;

producing a maximum signal and a minimum signal by means of said digital computer in accordance with said maximum value and said minimum value, respectively, said producing step being performed only when said first electrical signal resulting in said maximum value is greater than a first setpoint and said first electrical signal resulting in said mimimum value is less than a second setpoint;

calculating, by means of said digital computer, a reference value in accordance with said maximum and minimum signals by using a predetermined algebraic function;

comparing, by means of said digital computer, the magnitude of the reference value with said first electrical signal to produce a third electrical signal indicative of the comparison result;

calculating, in response to said second and third electrical signals, the fuel feeding rate to the engine to produce a fourth electrical signal indicative of the calculated fuel feeding rate, by means of said digital computer;

converting said fourth electrical signal into a pulse signal having a variable pulse width which corresponds to said fourth electrical signal; and actuating, in response to said pulse signal, said fuel injection valve.

2. A method as claimed in claim 1, wherein said first stepoint value is selected between a value of the maximum signal in the previous repeating cycle and a value of the reference value in the previous repeating cycle.

3. A method as claimed in claim 2, wherein said second setpoint value is selected between a value of the minimum signal in the previous repeating cycle and a value of the reference value in the previous repeating cycle.

4. A method as claimed in claim 2 or 3, wherein said first setpoint value is determined to the means value of the maximum signal in the previous repeating cycle and the reference value in the previous repeating cycle.

5. A method as claimed in claim 4, wherein said: second setpoint value is determined to the mean value of the minimum signal in the previous repeating cycle and the reference value in the previous repeating cycle.

6. A method as claimed in claim 3, wherein said reference value is revised when said first electrical signal decreases.

7. A method as claimed in claim 3, wherein said method further comprises a step of restricting the difference between values of the reference values in the previous repeating cycle and in the present repeating cycle within a predetermined range.

8. A method as claimed in claim 3, wherein said reference value calculating step includes a step of restricting the calculated reference value within a predetermined range.

9. An air-fuel ratio control apparatus of an internal combustion engine comprising:

at least one fuel injection value;

exhaust gas sensing means for detecting the concentration of a predetermined component in the exhaust gas of said engine and for generating a voltage signal which represents the detected concentration;

means for intermittently sampling the voltage signal from said exhaust gas sensing means to produce a first electrical signal indicative of the sampled voltage;

means for detecting the operating condition of the engine to produce a second electrical signal indicative of the detected operating condition;

electrical digital computer means for: (1) finding the maximum value and the minimum value of said first electrical signal, (2) producing a maximum signal and a minimum signal in accordance with said maximum value and said minimum value, respectively, said producing function being performed only when said first electrical signal resulting in said maximum value is greater than a first setpoint and said first electrical signal resulting in said minimum value is less than a second setpoint, (3) calculating a reference value in accordance with said maximum and minimum signals by using a predetermined algebraic function, (4) comparing the magnitude of the reference value with said first electrical signal to produce a third electrical signal indicative of the comparison result; and (5) calculating, in response to said second and third electrical signals, the fuel feeding rate to produce a fourth electrical signal indicative of the calculated fuel feeding rate;

means for converting said fourth electrical signal into a pulse signal having a variable pulse width which corresponds to said fourth electrical signal; and means for actuating, in response to said pulse signal, said fuel injection valve.

10. An apparatus as claimed in claim 9, wherein said first setpoint value is selected between a value of the maximum signal in the previous repeating cycle and a value of the reference value in the previous repeating cycle.

11. An apparatus as claimed in claim 10, wherein said second setpoint value is selected between a value of the minimum signal in the previous repeating cycle and a value of the reference value in the previous repeating cycle.

12. An apparatus as claimed in claim 10 or 11, wherein said first setpoint value is determined to the mean value of the maximum signal in the previous repeating cycle and the reference value in the previous repeating cycle.

13. An apparatus as claimed in claim 12, wherein said second setpoint value is determined to the mean value of the minimum signal in the previous repeating cycle and the reference value in the previous repeating cycle.

14. An apparatus as claimed in claim 11, wherein said reference value is revised by said computer means when said first electrical signal decreases.

15. An apparatus as claimed in claim 11, wherein said digital computer means also restricts the difference between values of the reference values in the previous repeating cycle and in the present repeating cycle within a predetermined range.

16. An apparatus as claimed in claim 11, wherein said reference value calculating function of said computer means restricts the calculated reference value within a predetermined range.

* * * * *